United States Patent [19]

Grover

[11] 4,168,068

[45] Sep. 18, 1979

[54] GOLF CLUB SWING TRAINING DEVICE

[76] Inventor: Russell C. Grover, R.R. #1, Box 101, Henry, Ill. 61537

[21] Appl. No.: 848,942

[22] Filed: Nov. 7, 1977

[51] Int. Cl.[2] ..... A63B 69/36

[52] U.S. Cl. ..... 273/186 A; 273/194 B

[58] Field of Search ..... 273/186 R, 186 A, 194 R, 273/194 A, 194 B, 26 B, 29 A; 272/124

[56] References Cited

U.S. PATENT DOCUMENTS

| | | | |
|---|---|---|---|
| 1,471,794 | 10/1923 | Leven | 273/186 A |
| 1,538,654 | 5/1925 | Reach | 273/186 A |
| 1,712,609 | 5/1929 | Gibson | 273/186 A |
| 1,877,218 | 9/1932 | Blank | 272/137 |
| 2,135,648 | 11/1938 | Stumpf | 273/186 A |
| 2,223,647 | 12/1940 | Stumpf | 273/186 A X |
| 2,543,722 | 2/1951 | Hetzel | 273/194 R |
| 2,986,937 | 6/1961 | Chapman | 273/186 A X |
| 4,027,886 | 6/1977 | Katsube | 273/186 A |

*Primary Examiner*—George J. Marlo

*Attorney, Agent, or Firm*—Hill, Van Santen, Steadman, Chiara & Simpson

[57] ABSTRACT

A velocity indicator for a swingable, striking device for indicating physically the velocity of the striking part at the time of its maximum speed, especially desirable for golf clubs. The indicator is in the form of a single unitary structure easily clamped on a club shaft or taken off without the use of any tools; said indicator being very light in weight, and leaves an indication of a previous swing to compare with a present swing. The device includes a weight member which is linearly displaced during the club swing and acts against a helical tension spring or a pair of rubber bands. A pair of indicator rings on a guide rod are adapted to be pushed by the weight on an initial swing of the club to indicate club velocity with the ring adjacent the weight then being manually retracted leaving the other ring in its advanced position as a target for a subsequent swing pushing the retracted ring so that its advanced position relative to the other ring may be noted to provide a comparison of club swing velocities.

4 Claims, 12 Drawing Figures

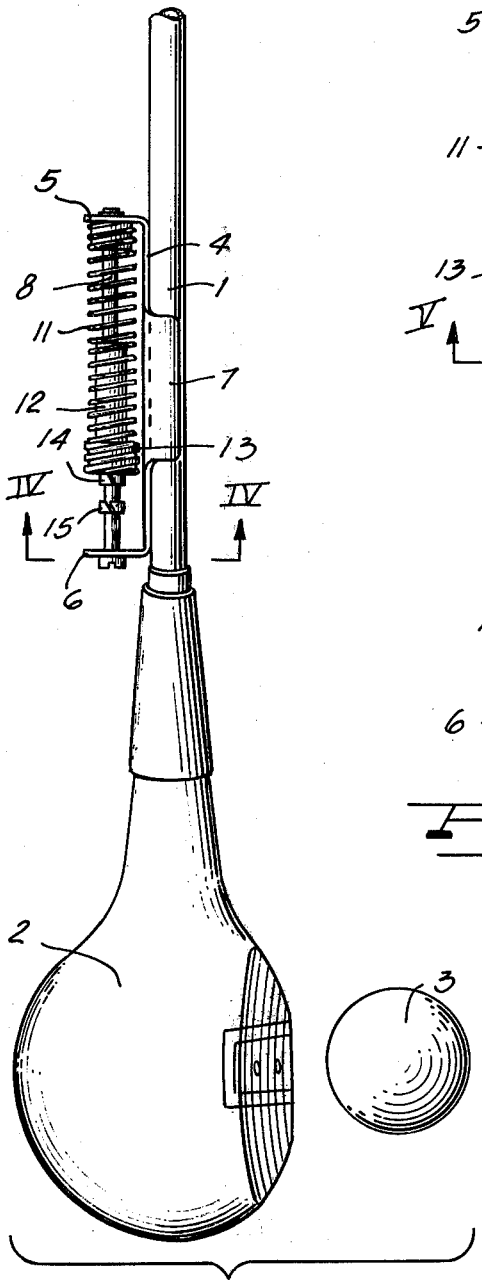
Fig. 1
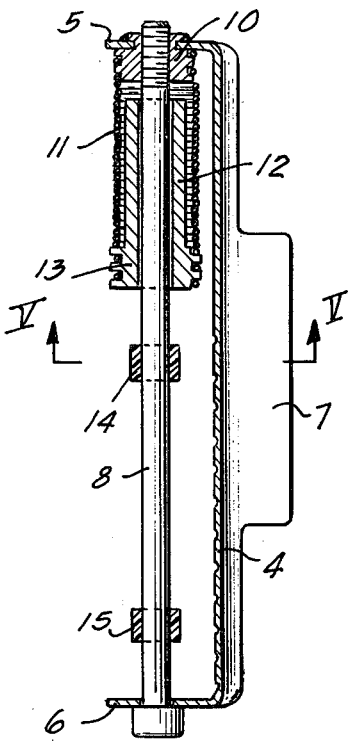
Fig. 3
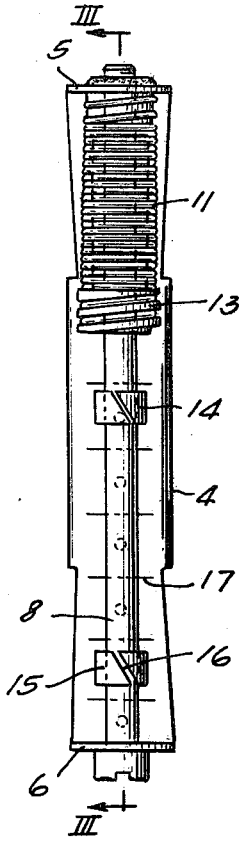
Fig. 2
Fig. 4
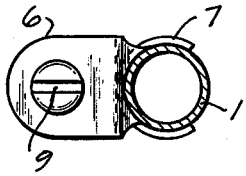
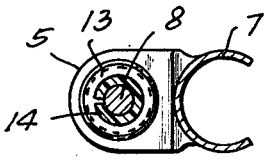
Fig. 5

GOLF CLUB SWING TRAINING DEVICE

BRIEF SUMMARY OF THE INVENTION

The instant discovery or invention, while shown and described herein in connection with a golf club, could be used for other striking instruments where velocity is important to know, such, for example, as baseball bats, tennis rackets, polo mallets, etc.

Each embodiment of the invention herein shown is made of component parts assembled into a unitary composite structure which may be quickly and easily snapped on a golf club shaft or is easily pulled off the shaft without the use of any tools. The component parts in general include a weight acting against resilient tension resistance, such as a helical tension spring or a pair of rubber bands, the weight in certain instances being tubular sliding over a guide rod, and in other instances the guide rod acts as the weight itself. Mounted upon the guide rod in that portion of the same projecting beyond the tension means when the device is static are two indicator rings mounted to indicate the difference in velocity between a previous swing of the club and a present swing of the club. Such unitary assemblies may be made complete and need not be over three inches in length either after operation or when they are static. Each of them can be carried easily in the pocket and snapped on or off the club at any time the player desires, whereby he may make practice swings during a forced wait while playing golf. Each device is sufficiently light in weight so as not to adversely affect the swing by adding to the weight at the head of the club.

An important feature of the instant invention is the fact that the indicator may be used with any of a golfer's set of clubs, including woods or irons and can be used to strike playable conventional golf balls, whereby the player can practice at a driving range hitting standard golf balls and endeavor to perfect his swing or increase his distance with any of his clubs.

Another important feature of the invention is the fact that the capacity of the indicator may be varied through a wide range of club velocities to suit golfers from novices to professionals. This is accomplished by increasing or decreasing the number of ineffective coils of the tension springs, or by changing the number or strength of the rubber bands.

BRIEF DESCRIPTION OF THE DRAWINGS

FIG. 1 is a composite showing of an indicator embodying principles of this invention mounted in operating position upon the shaft of a golf club adjacent the head, substantially at the moment of impact of the head with the golf ball;

FIG. 2 is an enlarged view of the indicator taken from the left hand side of FIG. 1;

FIG. 3 is a vertical sectional view taken substantially as indicated by the line III—III of FIG. 2;

FIG. 4 is a bottom plan view taken substantially as indicated by the line IV—IV of FIG. 1;

FIG. 5 is a bottom plan sectional view taken substantially as indicated by the section line V—V of FIG. 3;

Figure 6:
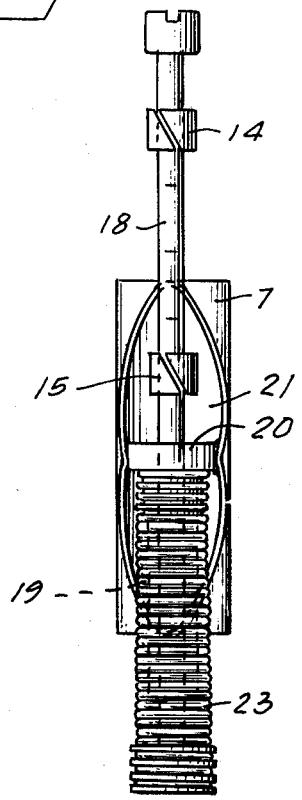
FIG. 6 is a view of a modified form of the invention taken in the same location as FIG. 2.

All the drawing figures except FIG. 1 have been enlarged for purposes of clarity.

DETAILED DESCRIPTION

All four embodiments of the instant invention show an indicating device operating upon the principle of a weight moving linearly against a tension resistance. The weight operates a positive indicator that shows the velocity of the club head and in the illustrated showings, the respective weights are acting against tension springs or rubber bands. Referring to the first embodiment of the invention, FIGS. 1–5, FIG. 1 shows the tension device mounted on a club shaft 1 near the head 2 of the club which has just contacted a standard golf ball 3. For that particular swing, the club head is at its maximum velocity when it strikes the ball and the indicating device is in its extended or active position for that particular swing, while in FIGS. 2 and 3, the enlarged showings, the device is in static position.

The indicating device includes a bracket 4 having outwardly turned upper and lower end portions 5 and 6, respectively. These end portions carry the major indicating mechanism. Extending in the opposite direction from the end portions about midway of the bracket is a spring clip 7 integral with the bracket for snapping the entire device on the club shaft or just as easily removing it without the use of any tools and in the manner of a few seconds.

The indicating mechanism per se includes a guide rod 8 which extends through the turned end portions 5 and 6 of the bracket 4. The lower end of the guide rod has a head with a diametral slot 9 therein to facilitate screwing the other end of the guide rod through a spring attachment plug 10 which is fixed to the turned end 5 of the bracket. One end of a spirally coiled tension spring 11 is fastened to the plug 10. Surrounding the guide rod 8 inside the spring is a tubular weight 12. This weight 12 has an enlarged lower end 13 which has a square or acme-type thread groove to which the lower end of the spring 11 is connected. When the golf club is swung it will have its maximum centrifugal force at the point where the head hits the ball and the weight 12 will cause the spring 11 to stretch as indicated in FIG. 1.

For indicating the velocity of the head of the club at the point of impact with the ball, a pair of indicators are preferably provided, an upper indicator 14 and a lower indicator 15. Each of these indicators is cut from a rigid plastic tube and has an oblique slit 16 therein. Each indicator fits over the guide rod 8 with just enough friction to prevent its sliding on the rod unless it is pushed by the weight. As the golf club passes through its point of maximum velocity and starts rising in the follow-through portion of the stroke, the spring 11 will retract and draw the weight up into static position, 14 and 15, however, will remain where they were pushed on the guide rod.

As indicated by numeral 17 in FIG. 2, either the guide rod or the inner face of the bracket may be graduated as desired, and by practice or adjustment of the apparatus various yardages may be determined.

It will be noted that the instant invention is satisfactory for use by a novice or beginning golfer and also by a highly accomplished golfer. Obviously, the better golfer swings harder than the beginner, and the better golfer for long shots will have higher velocity when the ball is hit than the beginner. The instant invention can be adjusted to accommodate either golfer. In the structure illustrated in FIGS. 1–5, increased tension is produced in the spring by rotating the weight to wind more of the spring coils onto the portion 13 of the weight, thereby reducing the number of effective spring coils. Rotating the weight in the opposite direction will add to the number of effective coils, thereby lessening the tension of the spring. A simple adjustment of this kind can be done quickly and easily and the golfer selects the spring tension that suits him best.

The use of two indicator rings 14 and 15 is very helpful to the golfer. Many golfers wish to improve their swings by adding to the velocity of the club and lengthening the hit, while other golfers desire to take substantially a full swing on every hit until reaching the green, depending upon the angle of the club face to determine the height and distance of the ball. A comparison between a first swing and a second swing is therefore desirable. Looking at FIG. 1 and assuming that the element 15 indicates a previous swing, the present swing indicated by element 14 is not as satisfactory as the previous one. For the next stroke, the golfer should move the element 14 upwardly until it contacts the weight, leaving the element 15 where it is and using it as a goal or target to be equaled or surpassed by the next swing of the club.

Figure 7:
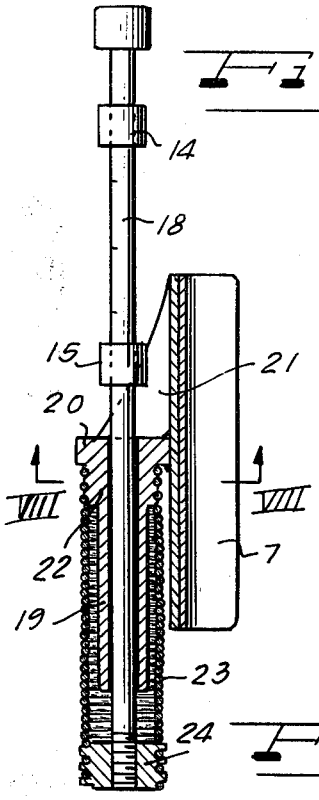
FIG. 7 is a vertical sectional view, with parts in elevation, and in the same location as FIG. 3.
Figure 8:
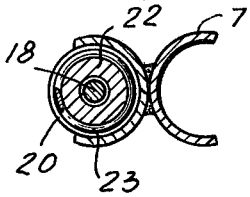
FIG. 8 is a bottom plan view taken substantially as indicated by section line VIII—VIII of FIG. 7.

In the structure shown in FIGS. 6, 7 and 8, a rod 18 similar to the above described guide rod 8 functions as the weight and reciprocates through a guide bushing 19 having a head 20 welded or equivalently secured to a bushing support 21 which in turn is welded or equivalently secured to the spring clip 7 which snaps on the shaft of the golf club near the head. An attachment plug 22 is formed integrally beneath the enlarged head of the bushing and the shank thereof to which a spirally wound tension spring 23 is connected. The lower end of the spring is connected to an attachment plug 24 threaded on the end of the weight 18. This attachment plug 24 is provided with a square or acme-type thread groove to which the lower end of the spring is connected. Rotation of the rod 18 and attachment plug 24 in one direction will cause more coils of the spring 23 to wind on and even past the plug 24 thereby reducing the number of effective coils of the spring and increase the tension of the spring, whereas rotation in the opposite direction will add to the number of effective spring coils and decrease the tension of the spring. In this manner, the indicating apparatus is adjusted to the desire or ability of any particular golfer.

The graduated scale would of necessity be on the rod 18. Two indicator rings 14 and 15 as above described, are used on the rod 18. The upper ring 14 may be moved upwardly as far as desired and the lower ring 15 should be moved down against the head of the guide rod bushing. After a swing has been made, and the follow through portion of the swing causes the spring to move the rod upwardly, both indicator rings 14 and 15 will move upwardly with the rod but if they have touched, the second swing was as good as intended by the setting of the upper indicator 14. If there is a space between the indicator rings, then that space indicates how poorly the second swing was in comparison with the first swing. If the lower indicator ring 15 is spaced above the head 20 of the guide bushing, and after the swing is over, both indicating rings are found in contact with each other at the top of the rod 18 it shows that the second swing or the intended swing was the better.

Figure 9:
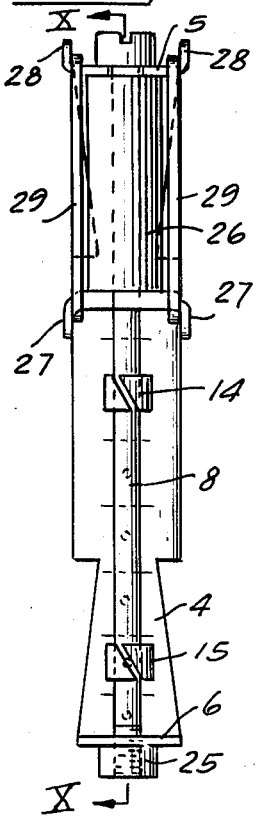
FIG. 9 is a view similar in location to FIG. 2, showing a tubular weight acting against the resistance of rubber bands, another modification.
Figure 10:
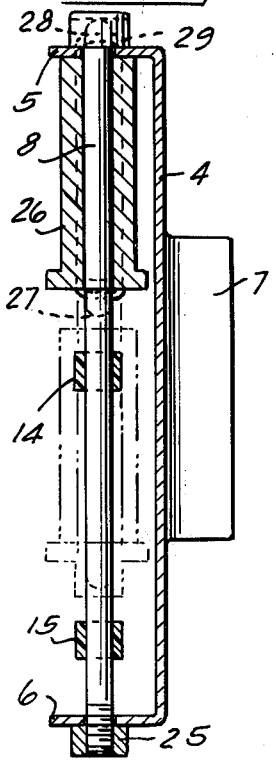
FIG. 10 is a vertical sectional view taken substantially as indicated by the line X—X of FIG. 9.

Referring now to FIGS. 9 and 10, we have a device similar to that in FIGS. 1–5 but the weight acts against the resilient resistance of rubber bands rather than a spring. The guide rod 8 is fitted at one end into the stud 25 secured to the bottom of the turned flange 6 on the bracket 4 which bracket supports spring clips that snap on club shaft in the manner outlined in connection with the first embodiment of the invention.

The tubular weight 26 surrounds the guide rod 8 and at its lower end is provided with a pair of downwardly extending hooks 27—27; and the upper flange 5 on the bracket 4 is provided with diametrically opposed upstanding hooks 28—28. The hooks 27 are aligned with the hooks 28 to provide free and balanced movement with the weight, and a pair of rubber bands 29—29 are engaged one on each side of the weight over the respective hooks 28 and 27.

When the club is swung the weight drops against the resistance of the rubber bands and moves the upper indicator ring 14 in the manner described in connection with FIG. 1. This embodiment of the invention may have the graduated scale on the inside face of the bracket 4 to denote comparison between successive swings of the club.

This form of the invention may be adjusted to accommodate the ability and experience of any particular golfer. That is done simply when the tension resistance is to be reduced by merely substituting weaker rubber bands for those already on; and if the tension is to be increased, heavier rubber bands may be substituted for the ones already on or another pair of rubber bands may be added, etc.

Figure 11:
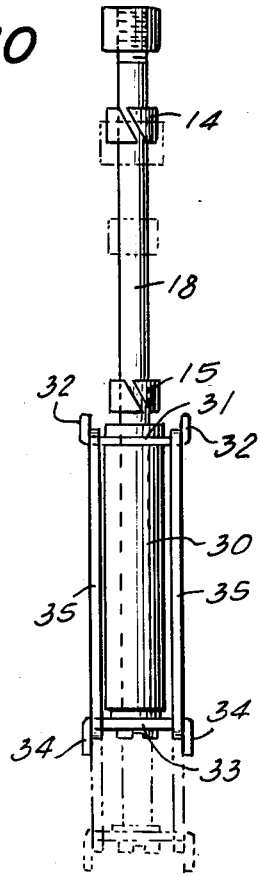
FIG. 11 is still another modification similar to the structure of FIG. 6 but showing a guide rod, with the guide rod acting as a weight against the restriction of rubber bands.
Figure 12:
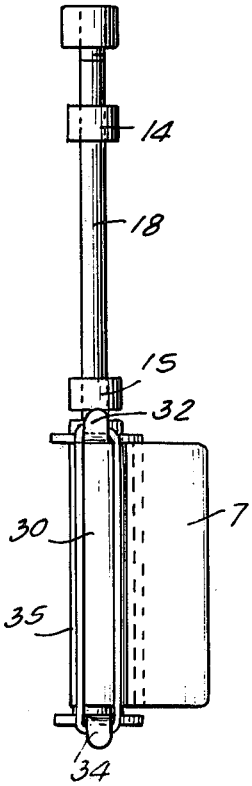
FIG. 12 is a side elevational view taken from the right side of FIG. 11.

The embodiments of the invention seen in FIGS. 11 and 12 operate similarly to that shown in FIGS. 6–8 with the exception tension resistance to the movement of the weight is by way of rubber bands rather than the spring. A guide tube fixedly connected to the spring slip 7 has a cross member 31 fixed to the top thereof. This member 31 has an apertured disc-like center portion carrying diametrically disposed upwardly turned hooks 32—32. The above described rod 18 acts as the weight and its lower end carries a cross member 33 similar to the member 31 but having downwardly turned hooks 34—34 thereon. The hooks 32—32 and 34—34 are connected by a pair of rubber bands 35—35, thus holding the weight or rod 18 in its upper position as seen in solid lines in FIGS. 11 and 12. When the club is swung the rod 18 moves downwardly as shown in phantom at the bottom of FIG. 11 to whatever extent the centrifugal force at the bottom of the swing may affect the weight. Since the indicator rings 14 and 15 slide up and down with the rod the same as they did in FIG. 6, if any graduated scale is desired, it must be on the rod 18. These indicator rings may be adjusted in the same manner as described in connection with FIGS. 6–8 between swings, or in any other manner the player desires depending upon what feature of his swing he is trying to improve at any particular time. That is true for all the embodiments shown in the drawings. The apparatus may be adjusted to better accommodate any particular golfer by adding or substituting heavier rubber bands to increase tension and substituting weaker rubber bands to reduce tension.

From the foregoing it is apparent that I have provided velocity indicating means of great use to improve a golfer's swing. A golfer taking practice swings to increase club head velocity for greater distance makes many changes in his grip, stance, follow through, back swing, etc., but has no way to confidently determine the effect produced by each such change. When he is given the means to quickly determine the effect of each change, he is enabled to improve his swing for greater distance. Any embodiment of the instant invention above described is suitable for striking conventional golf balls which permits the use of the device on a driving range and golf course. The indicators herein shown and described will withstand the violent shock and impact resulting in severe vibration. A good golf swing must have adequate club head velocity and more important adequate direction of ball flight. This can more easily be attained by striking standard balls in addition to merely swinging the club to improve velocity. Other advantages of the instant invention have been explained hereinabove.

I claim:

1. Velocity indicating means for a golf club to indicate physically the velocity of the club head when it strikes the ball, and including a weight having linear movement when the club is swung, wherein the improvement comprises the indicating means including an elongated rod, resilient tension resisting means acting against movement of the weight to adapt the indicating means to the ability or strength of any individual player, and a pair of indicating rings frictionally engaged on said rod and movable in one direction in response to a movement of said weight and movable selectively by hand in the other direction, whereby the one ring can show the result of a previous swing, and the other ring will show the result of a present swing for comparison with the result of the previous swing.

2. In a velocity indicating means for a golf club to indicate physically the velocity of the club head when it strikes the ball, and including adjustable resilient tension means to resist movement of a weight movable linearly in response to a swing of the club, the improvement which comprises a spirally coiled tension spring as the adjustable resilient tension means, a fixed plug to which the upper end of the spring is attached, an attachment plug carried by the lower end of said weight to which the lower end of said spring is connected, said attachment plug having a square or acme type thread groove therearound, whereby rotation of the weight relative to the spring winds more spring coils in the groove on the lower plug to lessen the effective spring coils and increase spring tension, or if the weight is turned in the other direction more coils are made effective and lessen spring tension.

3. Velocity indicating means for a golf club to indicate physically the velocity of the club head when it strikes the ball, said indicating means being attachable as a unit to and removable from the shaft of said golf club, wherein the improvement comprises a weight having linear movement in response to a swing of the golf club, a spirally coiled tension spring acting against movement of the weight to adapt the indicating means to the ability or strength of any individual player, a bracket having upper and lower outwardly turned ends, a spring clip integral with said bracket on the opposite side from said turned ends to snap the entire unit on the shaft of the club near the club head, a fixed guide rod between said turned ends, an attachment plug on the upper turned end of said bracket to which the upper end of said spring is attached, said weight being tubular and riding said rod inside said spring, said weight having an enlarged end with an acme thread groove to which the lower end of the spring is connected, and a pair of indicator rings on said guide rod below said weight.

4. Velocity indicating means for a swingable striking device used in a game to indicate physically the velocity of the striking part at its maximum speed, said indicating means being attachable to and removable from said striking device as a unit and including a weight having linear movement in response to a swing of the device, the improvement which comprises adjustable tension resistance means in the form of a plurality of rubber bands acting against movement of said weight when the club is swung, diametrically opposed fixed hooks carried by the lower end of said weight, a guide for said weight, diametrically opposed fixed hooks carried by the upper part of said guide, and rubber bands engaged over upper and lower hooks, whereby tension resistance to the weight travel may be lessened by substituting rubber bands of less strength, and increased by adding more rubber bands or substituting stronger rubber bands.

* * * * *